US012227326B2

(12) United States Patent
Vantrease

(10) Patent No.: US 12,227,326 B2
(45) Date of Patent: Feb. 18, 2025

(54) CLOSURE STRIP GUIDE AND METHOD

(71) Applicant: Irwin Research and Development, Inc., Yakima, WA (US)

(72) Inventor: Dale L Vantrease, Naches, WA (US)

(73) Assignee: Irwin Research and Development, Inc., Yakima, WA (US)

( * ) Notice: Subject to any disclaimer, the term of this patent is extended or adjusted under 35 U.S.C. 154(b) by 6 days.

(21) Appl. No.: 17/970,082

(22) Filed: Oct. 20, 2022

(65) Prior Publication Data

US 2023/0129996 A1 Apr. 27, 2023

Related U.S. Application Data

(60) Provisional application No. 63/270,490, filed on Oct. 21, 2021.

(51) Int. Cl.
*B65B 51/04* (2006.01)
*B65B 7/02* (2006.01)

(52) U.S. Cl.
CPC ..... *B65B 51/043* (2013.01); *B65B 7/02* (2013.01)

(58) Field of Classification Search
CPC ..... B65B 7/02; B65B 51/043; B65B 51/04; B65B 51/046; Y10T 29/53783; Y10T 24/155; Y10T 29/53787; Y10T 29/53896; Y10T 83/0538; Y10T 83/0548; Y10T 83/544; Y10T 83/825; Y10T 83/8805; B26D 1/305; B26D 2001/0066; B26D 1/085; B26D 1/385; B26D 2007/2685; B26D 7/2628
See application file for complete search history.

(56) References Cited

U.S. PATENT DOCUMENTS

| | | | |
|---|---|---|---|
| 529,639 | A | 11/1894 | Autrey |
| 767,123 | A | 8/1904 | Quinn |
| 796,389 | A | 8/1905 | Wright |
| 806,037 | A | 11/1905 | Wilcox |
| 994,119 | A | 6/1911 | Browning |
| 1,499,673 | A | 7/1924 | Lobl |

(Continued)

FOREIGN PATENT DOCUMENTS

| | | |
|---|---|---|
| GB | 1038510 | 8/1966 |
| GB | 1328146 | 8/1973 |
| WO | PCT/US2005/039680 | 5/2007 |

OTHER PUBLICATIONS

EP, EP 058195728 Supp Srch Rpt, Jul. 14, 2009, Irwin.

(Continued)

*Primary Examiner* — Veronica Martin
(74) *Attorney, Agent, or Firm* — Keith D. Grzelak; Wells St. John P.S.

(57) ABSTRACT

A closure strip guide is provided having a front plate, a back plate and a plate keeper. The back plate is carried proximate and spaced from the front plate to provide a gap thickness configured to guide a strip of clips. The plate keeper is configured to retain together the front plate and the back plate to retain the gap thickness to slidably receive and guide the strip of clips. The plate keeper also expands the gap thickness between the front plate and the back plate responsive to a stack-up jam to accommodate multiple layers of clips in the event the strip of clips dislodges and/or jams. A bag closing apparatus and a method are also provided.

20 Claims, 16 Drawing Sheets

(56) References Cited

U.S. PATENT DOCUMENTS

| | | | |
|---|---|---|---|
| 1,721,415 | A | 7/1929 | Schnefel |
| 2,799,923 | A | 7/1957 | Senshu |
| 2,890,706 | A | 6/1959 | Guardino |
| 2,995,820 | A | 8/1961 | Pocoski |
| 3,099,116 | A | 7/1963 | Platt |
| 3,163,969 | A | 1/1965 | Irwin |
| 3,163,972 | A | 1/1965 | Irwin |
| 3,164,249 | A | 1/1965 | Paxton |
| 3,164,250 | A | 1/1965 | Paxton |
| 3,188,737 | A | 6/1965 | Chase |
| 3,270,874 | A | 9/1966 | Hilton |
| 3,315,354 | A | 4/1967 | Oates |
| 3,370,396 | A | 2/1968 | Paxton |
| 3,417,902 | A | 12/1968 | Mirka |
| 3,583,131 | A | 6/1971 | Gaudlitz |
| 3,762,253 | A | 10/1973 | Loomis |
| 3,943,948 | A | 3/1976 | Sartore |
| 3,983,681 | A | 10/1976 | Britt |
| 3,997,966 | A | 12/1976 | Sartore |
| 4,026,413 | A | 5/1977 | Britt |
| 4,117,591 | A | 10/1978 | Terry |
| 4,176,449 | A | 12/1979 | Lee |
| RE30,196 | E | 1/1980 | Velarde |
| 4,196,514 | A | 4/1980 | Merriman |
| 4,215,606 | A | 8/1980 | Britt |
| 4,333,566 | A | 6/1982 | Holmes |
| 4,341,303 | A | 7/1982 | Britt |
| 4,361,935 | A | 12/1982 | Paxton |
| 4,428,134 | A | 1/1984 | Arnold |
| 4,509,231 | A | 4/1985 | Paxton |
| 4,534,149 | A | 8/1985 | Hoyland |
| 4,648,415 | A | 3/1987 | Yuan |
| 4,776,090 | A | 10/1988 | Grassi |
| D299,434 | S | 1/1989 | Burford |
| 4,809,431 | A | 3/1989 | Idema |
| 4,911,293 | A | 3/1990 | Holmes |
| 5,000,070 | A | 3/1991 | Ozawa |
| 5,052,416 | A | 10/1991 | Rommerdale |
| 5,063,666 | A | 11/1991 | Tsay |
| 5,074,041 | A | 12/1991 | Wagner |
| 5,129,210 | A | 7/1992 | Cicatello |
| 5,133,132 | A | 7/1992 | Yu |
| 5,138,748 | A | 8/1992 | Welles |
| 5,249,517 | A | 10/1993 | Massman |
| 5,488,772 | A | 2/1996 | Dababneh |
| 5,522,136 | A | 6/1996 | Larisey |
| 5,600,938 | A | 2/1997 | Trimble |
| 5,735,101 | A | 4/1998 | Shing-Tak Lam |
| 5,806,186 | A | 9/1998 | Langman |
| 6,098,370 | A | 8/2000 | Kobayashi |
| 6,173,497 | B1 | 1/2001 | Domenge |
| D539,140 | S | 3/2007 | Irwin |
| 7,434,369 | B2 | 10/2008 | Uneyama |
| 7,596,928 | B2 | 10/2009 | Irwin |
| 8,261,513 | B2 | 9/2012 | Irwin |
| 8,474,227 | B2 | 7/2013 | Irwin |
| 2005/0241275 | A1 | 11/2005 | Irwin |
| 2007/0107378 | A1 | 5/2007 | Frazier |
| 2011/0079123 | A1* | 4/2011 | Irwin ..... B26D 1/305 83/42 |

OTHER PUBLICATIONS

WO, PCT/US2005/039680 Srch Rpt, Jan. 8, 2007, Irwin.
WO, PCT/US2005/039680 Written Opin, Jan. 8, 2007, Irwin.
U.S. Appl. No. 60/605,185, filed Aug. 27, 2004.

* cited by examiner

CLOSURE STRIP GUIDE AND METHOD

CROSS REFERENCE TO RELATED APPLICATION

This application claims priority to U.S. Provisional Patent Application Ser. No. 63/270,490, entitled "Closure Strip Guide and Method", which was filed on Oct. 21, 2021; the entirety of which is incorporated by reference herein.

TECHNICAL FIELD

This disclosure relates to article bagging systems and methods. More particularly, the present disclosure pertains to machines and methods for applying bag clips, or closures, about a neck of a product-filled bag and for closure strip guide assemblies that accommodate operation when closures misfeed.

BACKGROUND OF THE INVENTION

Machines are known for preparing and applying clips onto the neck of a plastic bag. For example, U.S. Pat. Nos. 3,163,969; 3,163,972; and 7,596,928 disclose bag closing devices. However, improvements are needed when clips, or closures misfeed and/or stack up inside of a closure strip guide assembly and generate a jam that can interrupt continuous feeding during an automated bagging operation.

SUMMARY OF THE INVENTION

A bag closing apparatus, an expandable closure strip guide assembly, and a method are provided to accommodate continued operation when a jam or misfeed occurs in a bag closure strip guide by providing one of plurality of different expansible bag closure strip guide assemblies.

According to one aspect, a bag closing apparatus is provided having a frame and a closure strip guide. The frame is configured to carry a strip of clips. The closure strip guide has a front plate, a back plate, at least one strip guide cooperating between the back plate and the front plate to define a strip guide track, and a displaceable retainer. The strip guide track has a width and a depth to guide a strip of clips. The displaceable retainer is configured to retain together the front plate and the back plate into a stack to have a slot depth sized to slidably receive and guide the strip of clips. The displaceable retainer also enables expansion between the front plate and the back plate under a stack-up jam to accommodate multiple layers of clips in the event the strip of clips dislodges and/or jams.

According to another aspect, a closure strip guide is provided having a front plate, a back plate and a plate keeper. The back plate is carried proximate and spaced from the front plate to provide a gap thickness configured to guide a strip of clips. The plate keeper is configured to retain together the front plate and the back plate to retain the gap thickness to slidably receive and guide the strip of clips. The plate keeper also expands the gap thickness between the front plate and the back plate responsive to a stack-up jam to accommodate multiple layers of clips in the event the strip of clips dislodges and/or jams.

According to yet another aspect, a method is provided for clearing a jam in a strip closure guide of a bag closing apparatus. The method includes: providing a closure strip guide having a front plate, a back plate spaced from the front plate to define a gap sized to guide a strip of clips, and a displaceable retainer configured to retain together the front plate and the back plate sized to slidably receive and guide the strip of clips and enable expansion between the front plate and the back plate; urging apart the front plate and the back plate responsive to an overlap jam of more than one layer of the strip of clips present in the gap between the front plate and the back plate; advancing forward the overlap jam between the urged apart front plate and the back plate; and releasing the more than one layer of the strip of clips from between the front plate and the back plate to clear the overlap jam.

BRIEF DESCRIPTION OF THE DRAWINGS

Preferred embodiments of the disclosure are described below with reference to the following accompanying drawings.

DETAILED DESCRIPTION OF THE PREFERRED EMBODIMENTS

This disclosure is submitted in furtherance of the constitutional purposes of the U.S. Patent Laws "to promote the progress of science and useful arts" (Article 1, Section 8).

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
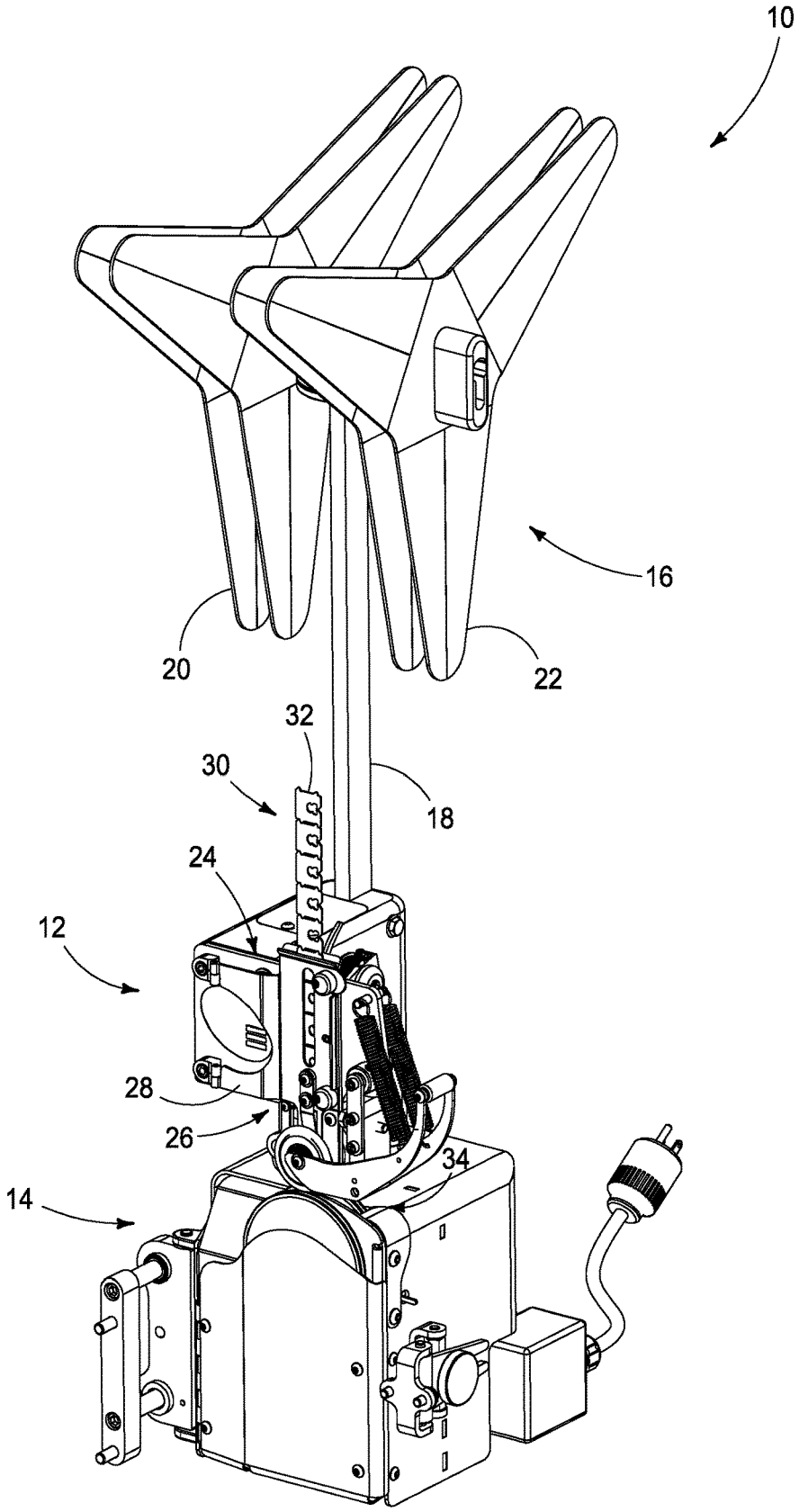
FIG. 1 is a simplified perspective view from above of a bag closing device with a closure strip guide assembly according to one aspect.

FIG. 1 is a simplified perspective view from above of a bag closing device 10 with a closure strip guide assembly 24 according to one aspect. More particularly, bag closing device 10 is constructed similar to the device described in U.S. Pat. No. 3,163,972 using frangible strips 30 of individual closures, or clips 32 that are individually loaded onto the necks of product bags, herein incorporated by reference. Bag closing device 10 includes an upper housing assembly 12, a lower housing assembly 14, a closure reel assembly 16, and a closure strip guide assembly 24. Reel assembly 16 includes a pair of bag closure reels 20 and 22 configured to store wound reels of frangible strips 30 of closures 32 and a vertical structural support post 18 rigidly affixed to upper housing assembly 12. A bag feed assembly 34 is carried by upper housing assembly 12 and lower housing assembly 14 configured to feed a bunched bag neck into bag closing device 10 to apply a closure 32, as known in the art. A retractable, or pivotal door 28 is magnetically affixed to define an expansible guide assembly 26 with remaining components of closure strip guide assembly 24.

Figure 2:
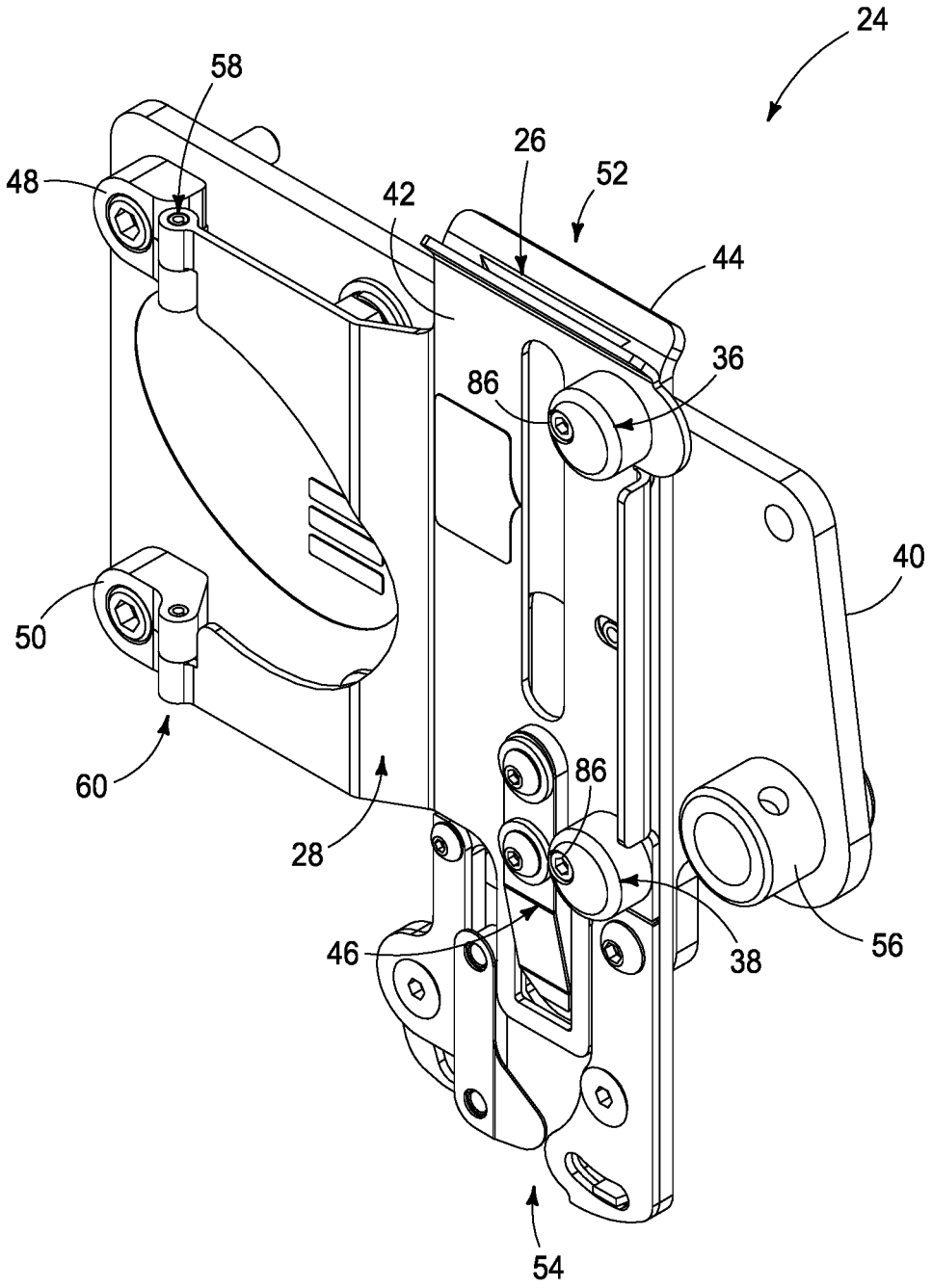
FIG. 2 is a component closure strip guide assembly for the bag closing device of FIG. 1 according to one construction.

FIG. 2 is a component closure strip guide assembly 24 for the bag closing device 10 of FIG. 1 according to one construction. More particularly, closure strip guide assembly 24 has a front door 28 that is magnetically and pivotally affixed to a back plate 44 of guide assembly 24 comprising ferrous metal that attracts magnets. Door 46 includes a pair of magnetic latch assemblies, or plate keepers 36 and 38 each affixed onto a front plate 42 of closure strip guide assembly 24 with a threaded fastener 86. A pair of hinge assemblies 58 and 60 aligned on a common vertical axis affix between hinge mounts 48 and 50 on a mounting base plate 40 and outer plate 42 of door 28. A one-way spring clip assembly 46 is affixed with threaded fasteners onto front plate 42 operative to limit motion of a strip of closures, or clips (not shown) from an entrance end 52 to an exit end 54 of closure strip guideway 26. Guideway 26 is expansible in the event of a jam or layered stack-up of clips in a strip as the magnets in magnetic latch assemblies 36 and 38 generate an attraction for between plates 42 and 44 even when spaced apart by several thicknesses of clips that are stacked up, or jammed, in guideway 26. In this manner, guideway 26 is expansible, or capable of increasing in a dimension matching the thickness of a closure so that multiple nested, or stacked clips can pass between plates 42 and 44 while magnetic latch assemblies 36 and 38 hold them together in an urged together, yet floating relationship that can have varying thickness, or depth in guideway 26. Such operation can enable continued and uninterrupted operation of a bagging machine even when a jam occurs as the machine continues to deliver a strip of closures and the extra layer(s) of overlapped, or jammed clips merely pass-through expanded guideway 26 out through outlet, or exit end 54. Finally, a bushing mount 56 for bag feed assembly 34 (see FIG. 1) is press fit (into a bore) or welded onto plate 40.

Figure 3:
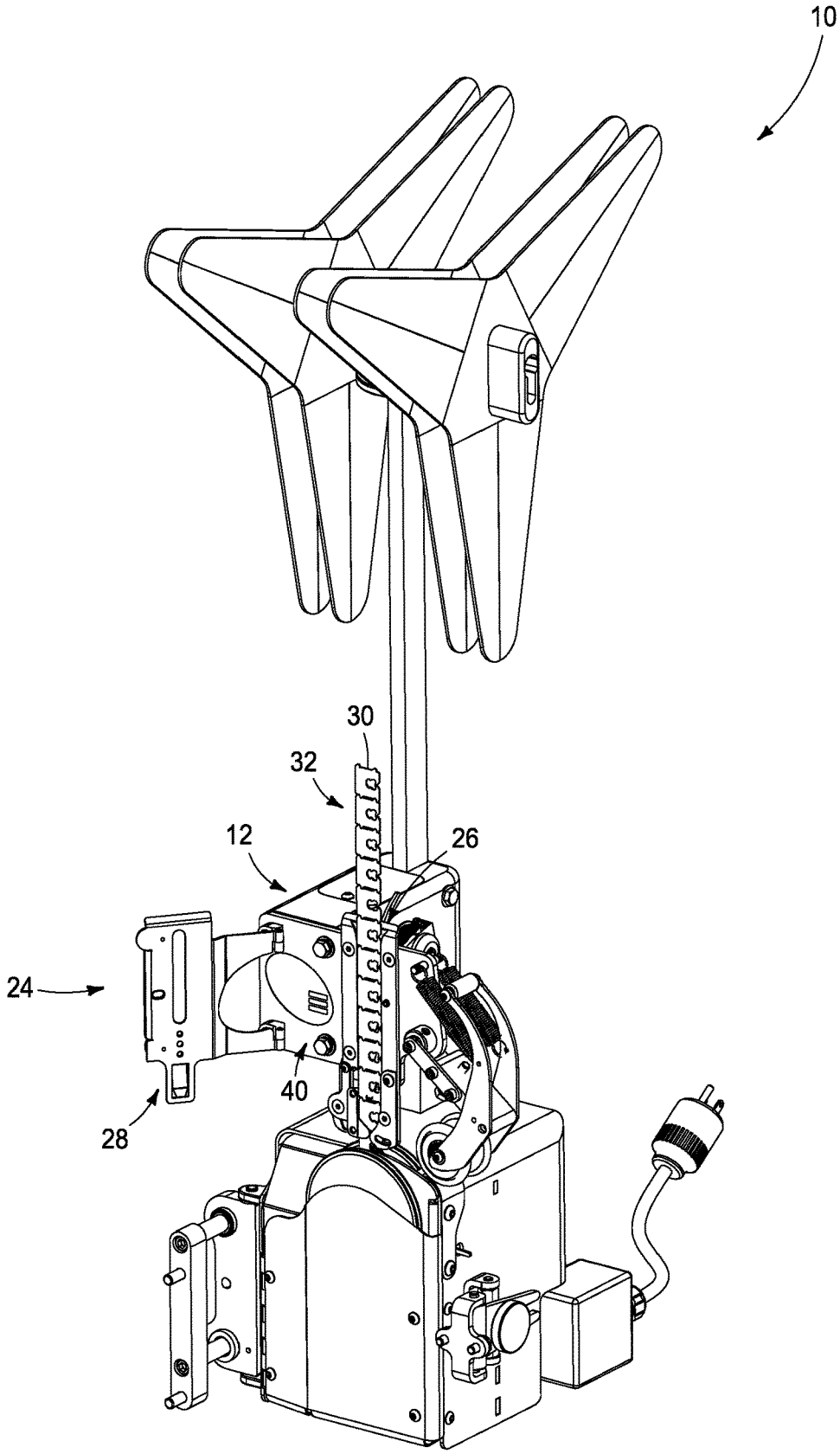
FIG. 3 is a simplified perspective view from above of a bag closing device with a closure strip guide assembly showing a front plate of the closure strip guide assembly opened.

FIG. 3 is a simplified perspective view from above of bag closing device 10 with closure strip guide assembly 24 and showing front pivot door 28 of the closure strip guide assembly 24 open relative to mounting plate 40. Strip 32 of closures, or clips 30 are shown entering expansible guideway 26 on upper housing 12.

Figure 4:
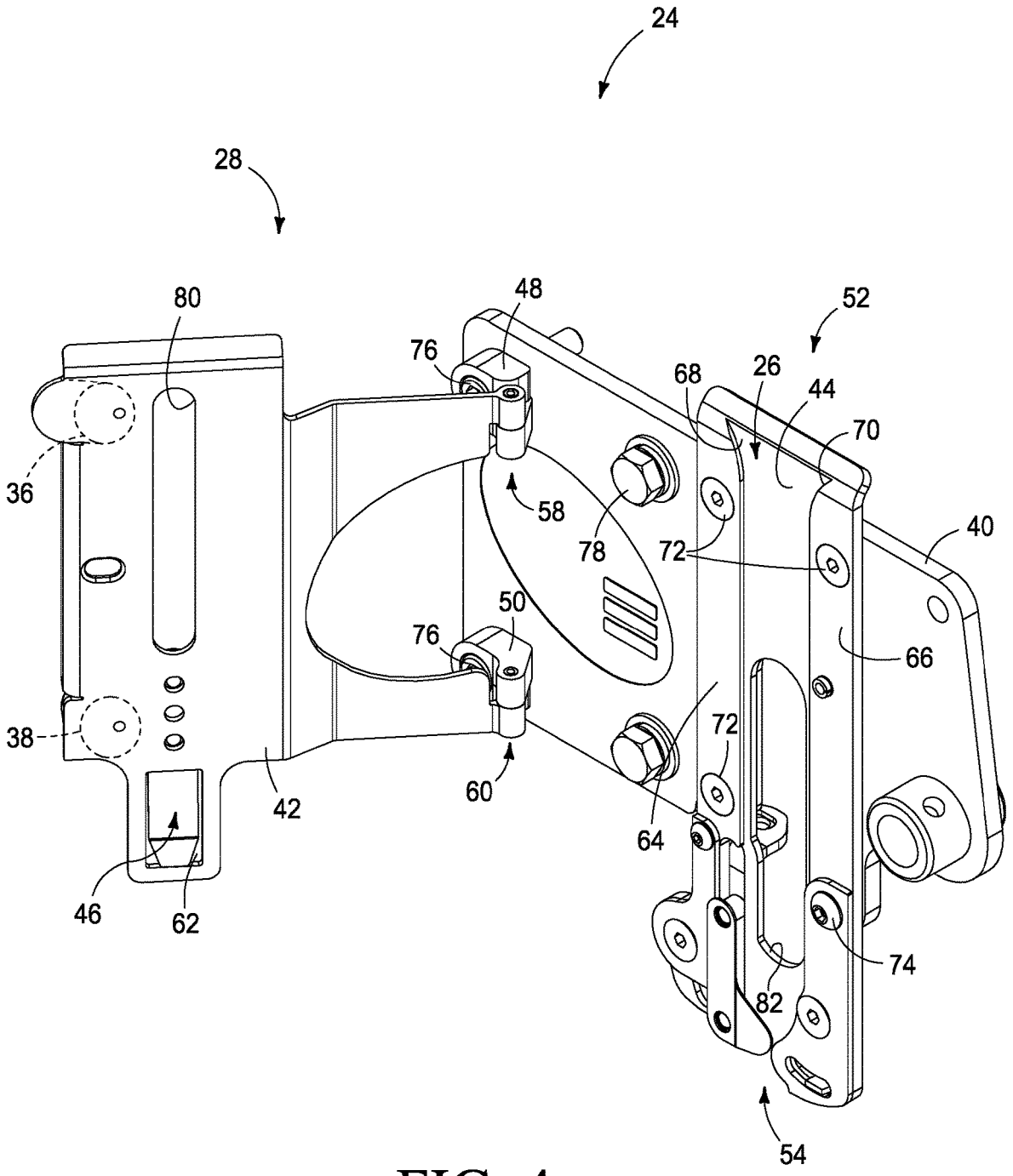
FIG. 4 is a component closure strip guide assembly for the bag closing device of FIG. 2 showing a front plate of the closure strip guide assembly pivoted, or expanded into an open position.

FIG. 4 illustrates component closure strip guide assembly 24 for the bag closing device of FIG. 2 showing front plate 42 of pivot door 28 of the closure strip guide assembly 24 pivoted, or expanded into an open position relative to rear plate 44 and mounting plate 40 suitable for maintenance and/or cleaning. Such position is beyond the ability of magnetic latch assemblies 36 and 38 to urge, or magnetically attract together plates 42 and 44 when under normal operation or when slightly expanded during a multiple layer stack-up, or jamming of closures, or clips. Plate 42 includes an aperture, or window 80 extending along guideway 26 from adjacent an upstream end 52 to a downstream end 54 that enables a user to view progression and status of a strip of closures being feed along guideway 26, including any jammed or overlapping layers of the strip of closures, or individual closures. Aperture, or window 62 is also provided in plate 42 through which one-way closure spring retainer 46 extends to engage a strip of closures moving downward along guideway 26 and preventing any upward movement. Finally, aperture, or window 82 is provided in back plate 44 (and mounting plate 40) to enable feed finger 92 of closure strip feed finger assembly 90 (see FIG. 9) to engage and incrementally move a strip of closures or clips downwardly along guideway 26.

As shown in FIG. 4, door 28 comprises front plate 42 which is pivotally affixed to mounting plate 40 via hinge assemblies 58 and 60, and hinge mounting blocks 48 and 50 are affixed with a respective threaded fastener 76 onto mounting plate 40 and to the upper housing assembly 12 (see FIGS. 1 and 3). Additionally, threaded fasteners, or bolts 78 further affix mounting plate 40 onto the upper housing assembly 12 (see FIGS. 1 and 3). An array of threaded fasteners 72 cooperate with threaded fastener 74 to affix back plate 44 onto a front surface of mounting plate 40. According to such implementation, spacer side strips 64 and 66 are integrally formed, or machined from back plate 44 to provide for guideway 26 which forms undercut side walls, or edges 68 and 70 that further retain and guide a strip of clips being conveyed along guideway 26 from an entrance, or upstream end 52 to an exit, or downstream end 54.

Figure 5:
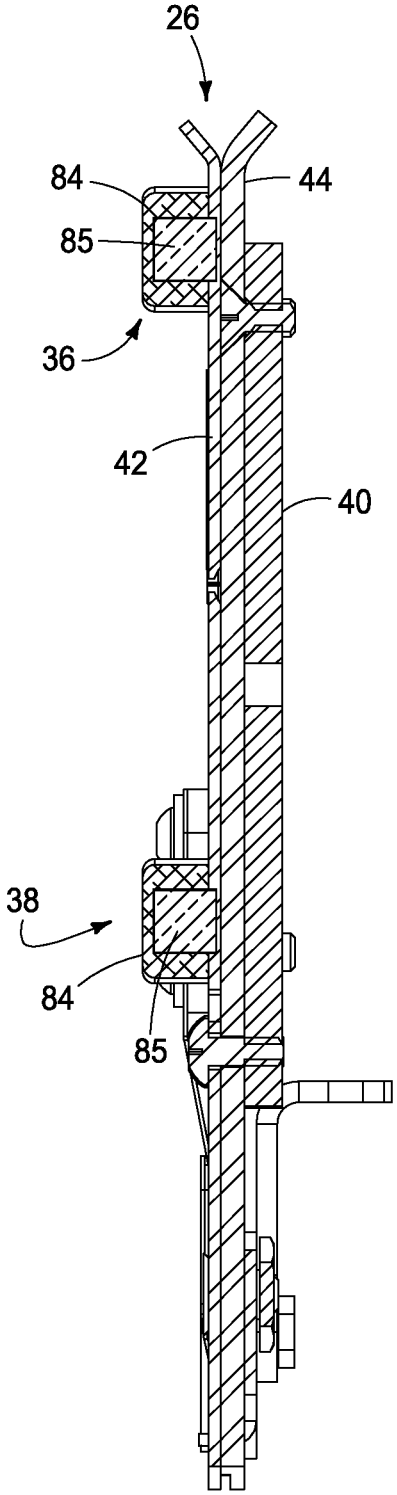
FIG. 5 is a vertical sectional view taken through line 5-5 of FIG. 6 showing magnetic latch assembly affixation of the front plate to the back plate of the closure strip guide assembly.
Figure 6:
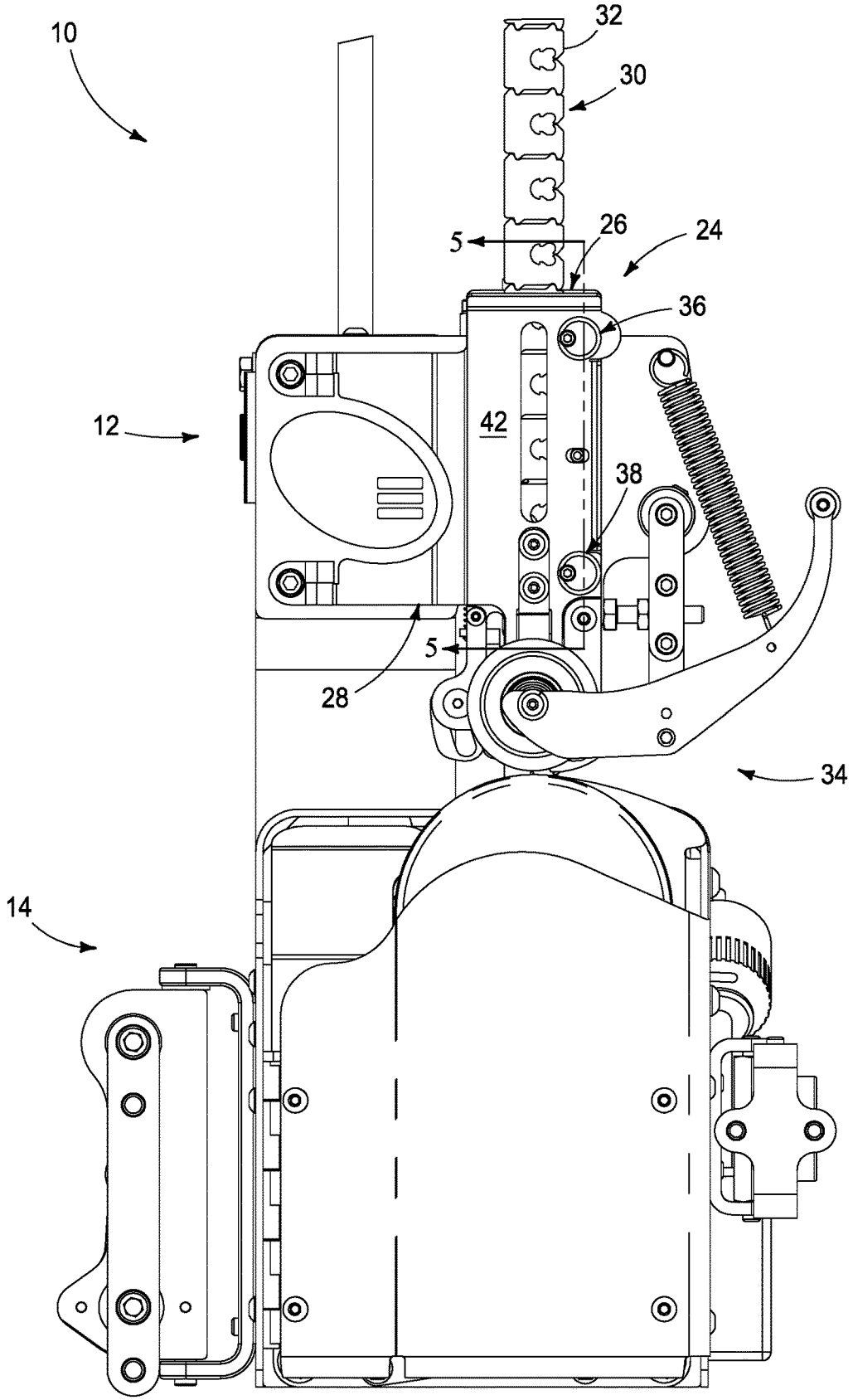
FIG. 6 is a front elevational view of the bag closing device with a closure strip guide assembly of FIGS. 1 and 3 with the front plate in a closed operating position.

FIG. 5 is a vertical sectional view taken through line 5-5 of FIG. 6 showing magnetic latch assembly affixation, or attachment of the front plate 42 to the back plate 44 of the closure strip guide assembly 24 to define guideway 26. Back plate 44 is further affixed to mounting plate 40. More particularly, each magnetic latch assembly 36 and 38 comprises a cylindrical metal outer housing shell 84 configured with an inner bore sized to contain a cylindrical rare earth magnet 85 to outer plate 42. According to one construction, outer plate 42 is made from stainless steel and housing shell 84 is made from aluminum. Other suitable materials can also be used.

FIG. 6 is a front elevational view of bag closing device 10 with closure strip guide assembly 24 of FIGS. 1 and 3 with the front plate 42 of the pivoting front door 28 in a closed operating position. Door 28 is held together with magnetic latch assemblies 36 and 38 to provide a normal single closure thickness dimension on expansible guideway 26 to receive strip 30 of closures, or clips 32. Bag feed assembly 34 is shown in a wheel-engaged, or closed operating position carried by upper housing assembly 12 and lower housing assembly 14.

Figure 7:
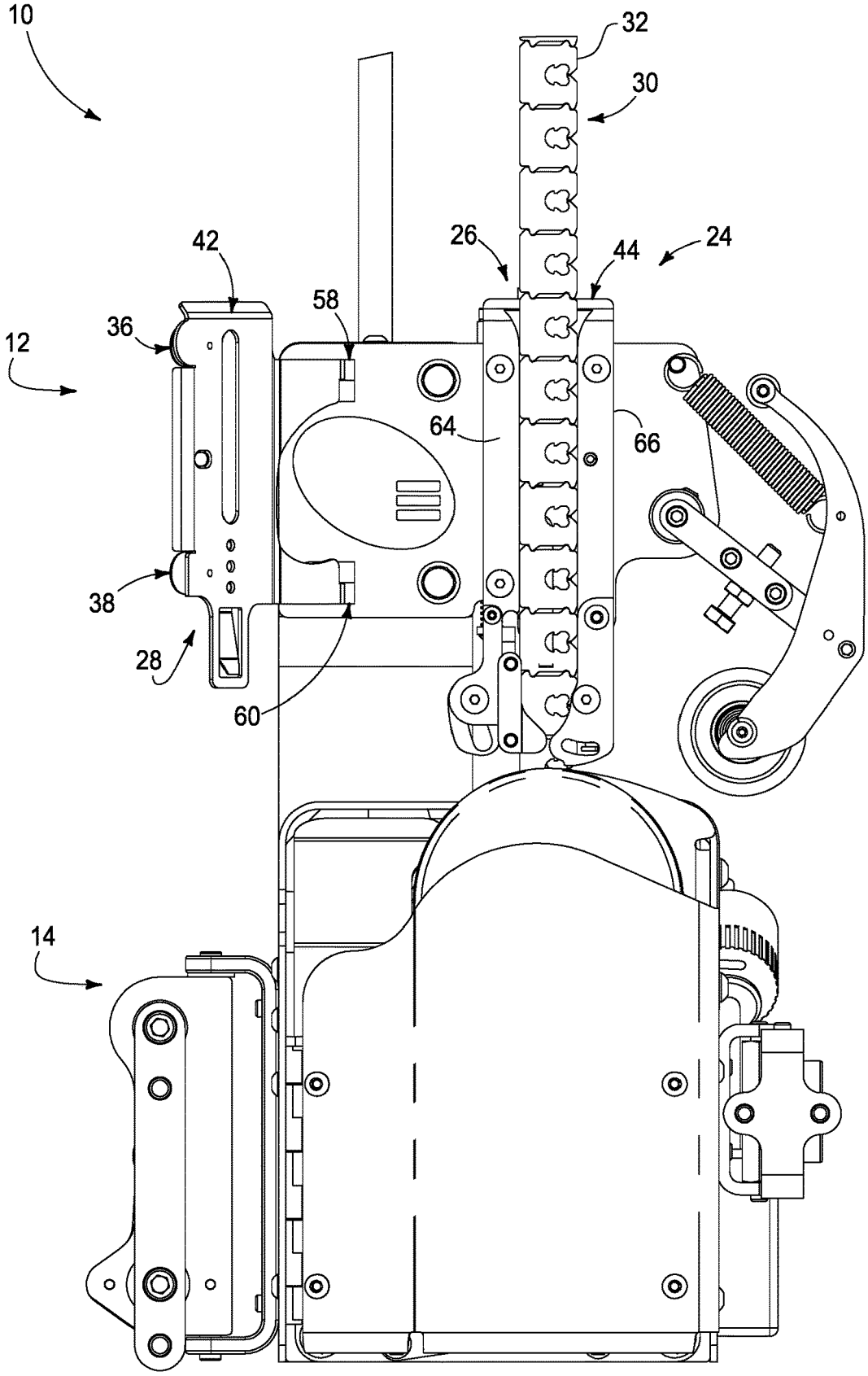
FIG. 7 is a front elevational view of the bag closing device with a closure strip guide assembly of FIGS. 1 and 3 with the front plate in a completely open position when cleaning, loading and/or maintaining the closure strip guide assembly and with a portion of the bag feed assembly pivoted out of the way to facilitate viewing.

FIG. 7 is a front elevational view of bag closing device 10 of FIG. 6 with closure strip guide assembly 24 having door 28 and front plate 42 shown in a completely open position suitable for cleaning, loading and/or maintaining closure strip guide assembly 24. A portion of the bag feed assembly is shown pivoted out of the way to facilitate viewing of components on upper housing assembly 12 and relative to lower housing assembly 14. As shown rotated about hinges 58 and 60, magnetic latch assemblies 36 and 38 are spaced far enough from plate 44 and ferrous metal spacer side strips 64 and 66 so as to not impart significant magnetic attraction sufficient to close door 28. Slidable guidance of strip 30 of closures, or clips 32 is more clearly shown in resulting guideway 26 of rear plate 44 as door 28 and front cover 42 are pivoted to such open position.

Figure 8:
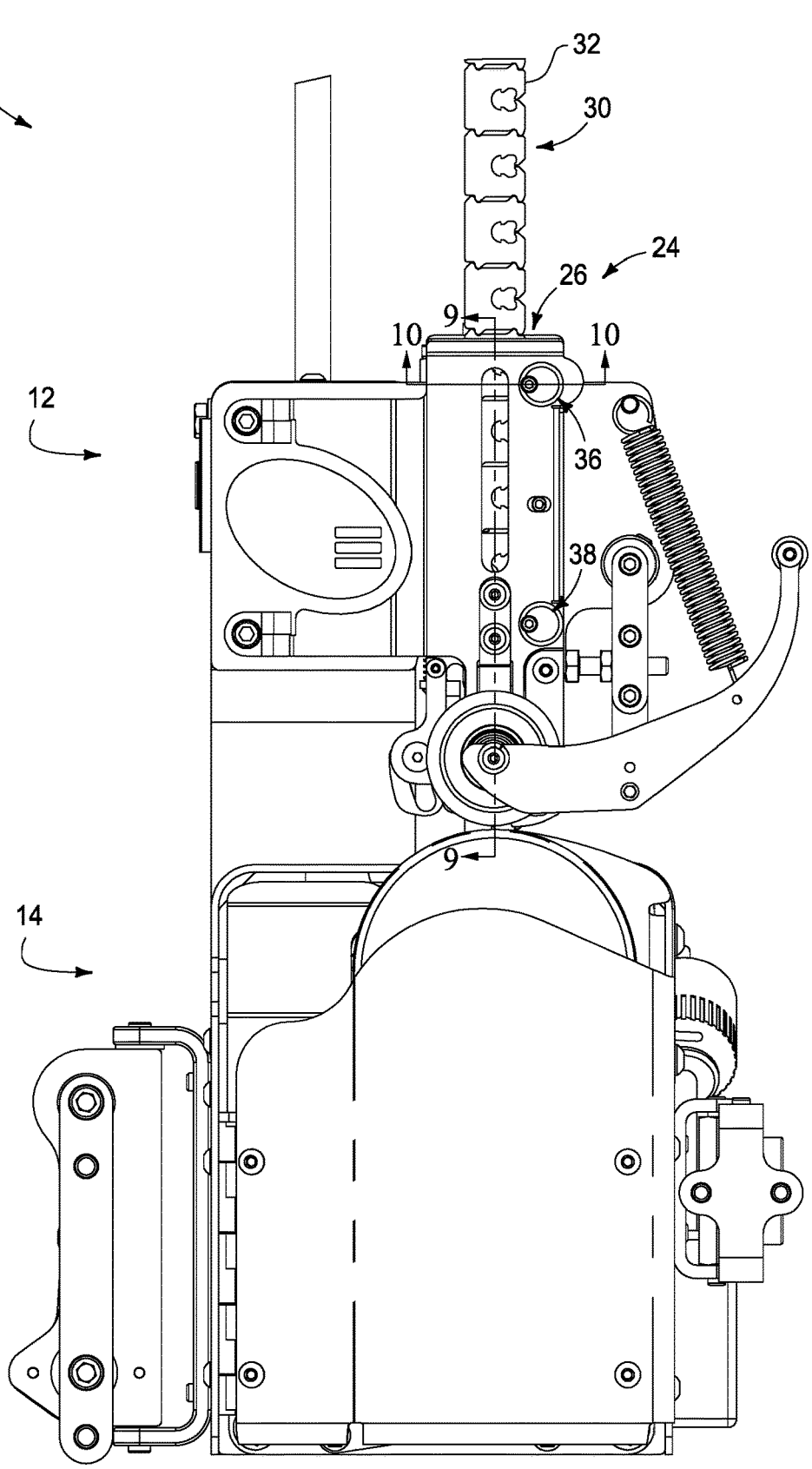
FIG. 8 is a front elevational view of the bag closing device with a closure strip guide assembly of FIG. 6 showing sectional cut lines for FIGS. 9 and 10.
Figure 9:
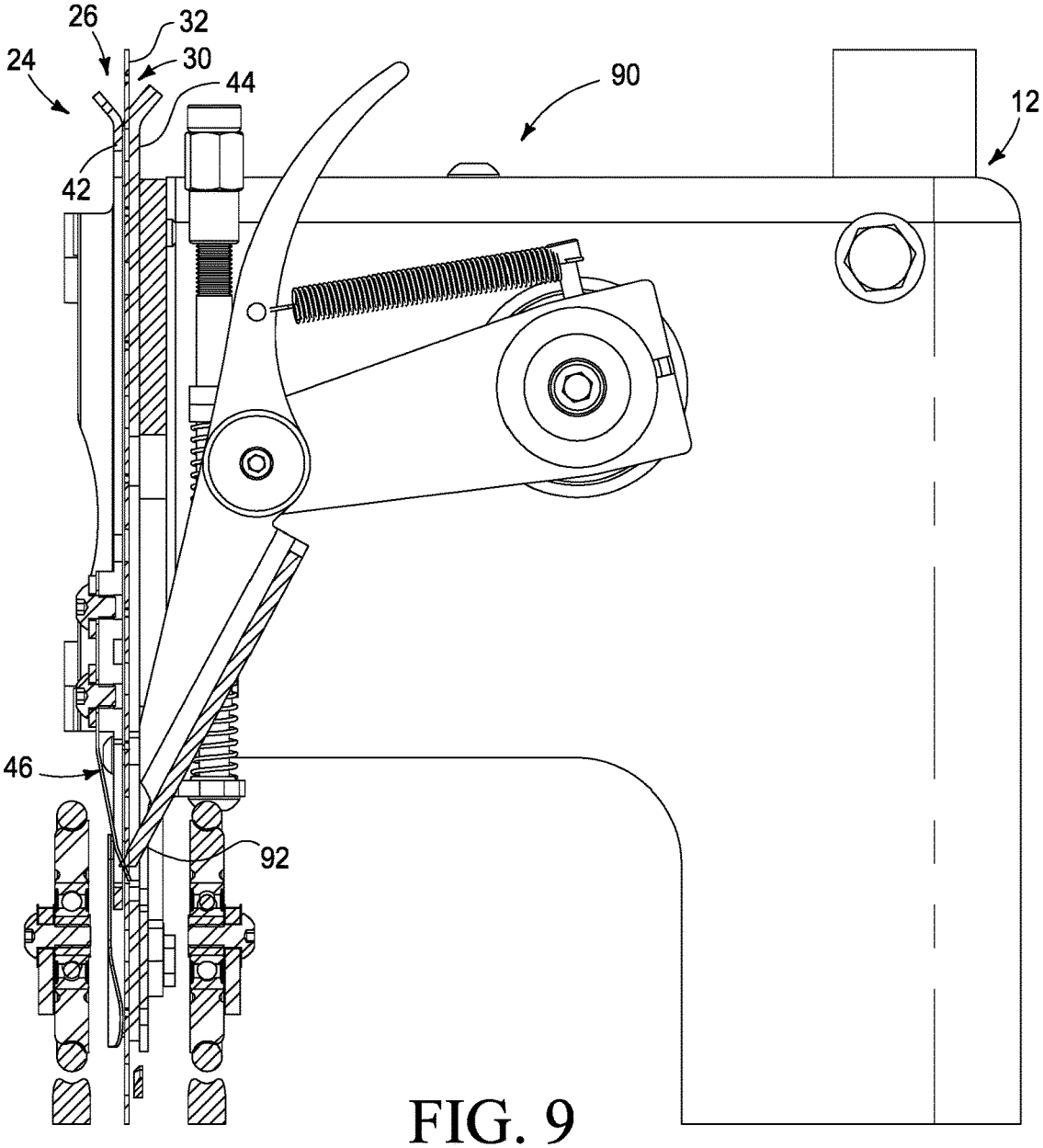
FIG. 9 is a vertical sectional view of a closure strip feed finger assembly and the expansible guideway taken along line 9-9 of FIG. 8.
Figure 10:
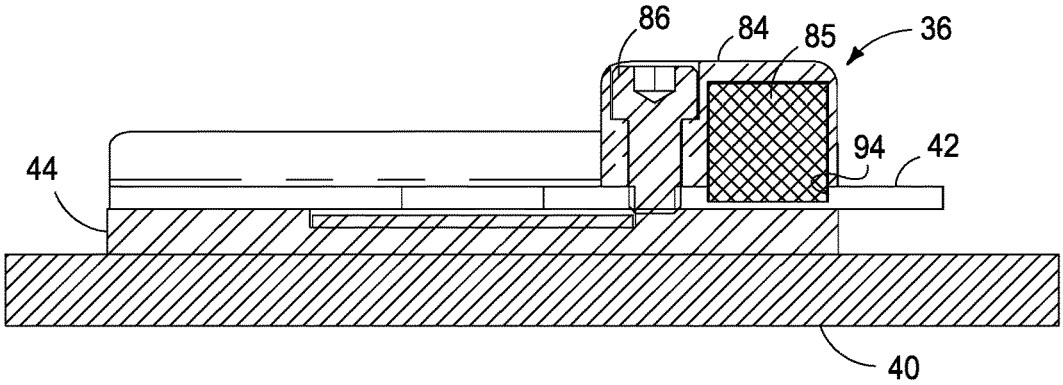
FIG. 10 is a horizontal sectional view of one magnetic latch assembly taken along line 10-10 of FIG. 8.

FIG. 8 is a front elevational view of bag closing device 10 with closure strip guide assembly 24 of FIG. 6 showing sectional cut lines 9-9 and 10-10 for FIGS. 9 and 10, respectively, taken to show components of closure strip guide assembly 24, but omitting upper housing assembly 12 and lower housing assembly 14 shown in FIG. 8. Magnetic latch assemblies 36 and 38 are shown in a closed position for closure strip guide assembly with strip 30 of closures, or clips 32 received in guideway 26.

FIG. 9 is a vertical sectional view of a closure strip feed finger assembly 90 and expansible guideway 26 provided by closure strip guide assembly 24 taken along line 9-9 of FIG. 8. Feed finger 92 of closure strip feed finger assembly 90 are supported for articulation relative to upper housing assembly 12 to engage and incrementally move a strip 30 of closures, or clips 32 downwardly along guideway 26. Front plate 42 is shown magnetically affixed to back plate 44 with a thickness gap sized to pass a single thickness of strip 30 of closures 32 between them. Spring steel clip assembly 46 flexes in operation to allow downward movement of each closure 32 in strip 30, but engages with a top edge of each closure to prevent any reverse or upward motion.

FIG. 10 is a horizontal sectional view of one magnetic latch assembly 36 taken along line 10-10 of FIG. 8 and showing affixation of assembly 36 onto front plate 42. More particularly, magnet 85 of assembly 36 (as well as assembly 38) is affixed into a complementary cylindrical bore 94 formed in stainless steel front plate 42 so that magnet 84 is sufficient close to magnetically couple with back plate 44 through a thin portion of plate 42. Threaded fastener 86 is offset radially within an outer periphery of aluminum cap 84, housing magnet 85 and threaded into front plate 42. Such structures are further supported by mounting plate 40, as previously described above.

Figure 11:
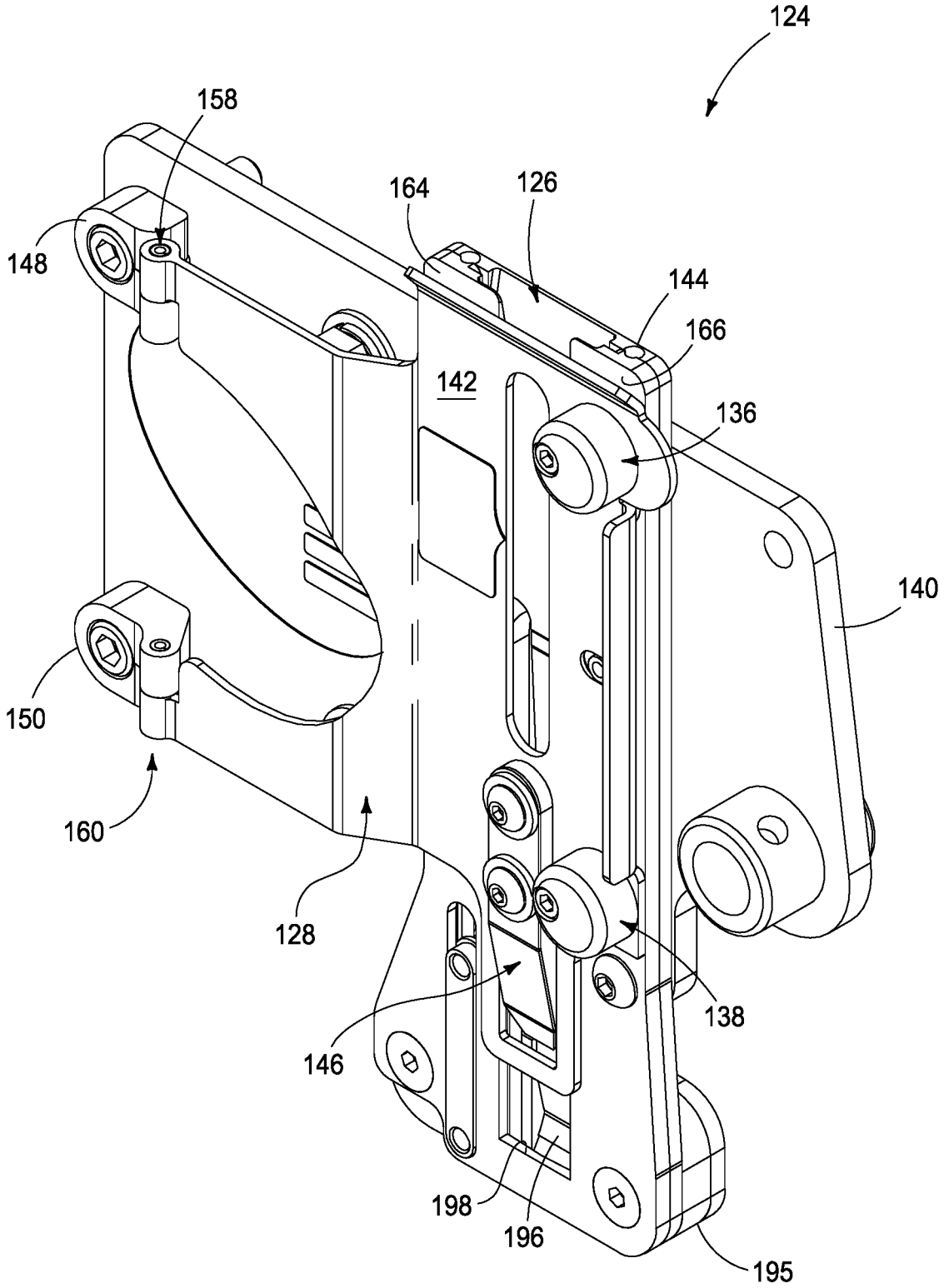
FIG. 11 is a perspective front view from above of a component closure strip guide assembly 124 for a bag closing device according to an alternate construction than that shown in FIGS. 1-10.

FIG. 11 is a perspective front view from above of one alternative construction component closure strip guide assembly 124 for a bag closing device, such as device 10 of FIGS. 1-10, over assembly 24 shown. According to such alternate construction, a magnetic plate keeper, or retainer is provided via magnetic latch assemblies 136 and 138 with a closure strip guide assembly 124 having spacer side strips 164 and 166 separate from back plate 144, but affixed together via fasteners. Plates 142, 144 and strips 164 and 166 cooperate to provide expansible guideway 26. In addition, closure strip guide assembly 124 is also implemented to work with a bag closing device that cuts, or severs individual closures, or clips from a strip of clips similar to the device described in U.S. Pat. No. 7,596,928, herein incorporated by reference.

Also shown in FIG. 11, door 128 is pivotally affixed via hinge assemblies 158 and 160 via hinge mounts 148 and 150, respectively, to mounting plate 140. Spring steel clip assembly 146 is affixed to front plate 142 to prevent upward movement of a strip of clips. A flexible finger cutter 196 engages with a complementary cutting edge 198 on plate 144 to sever individual closures, or clips from a strip. A cam drive plate 195 is pivoted to rotate finger cutter 196 to engage cutting edge 198.

Figure 12:
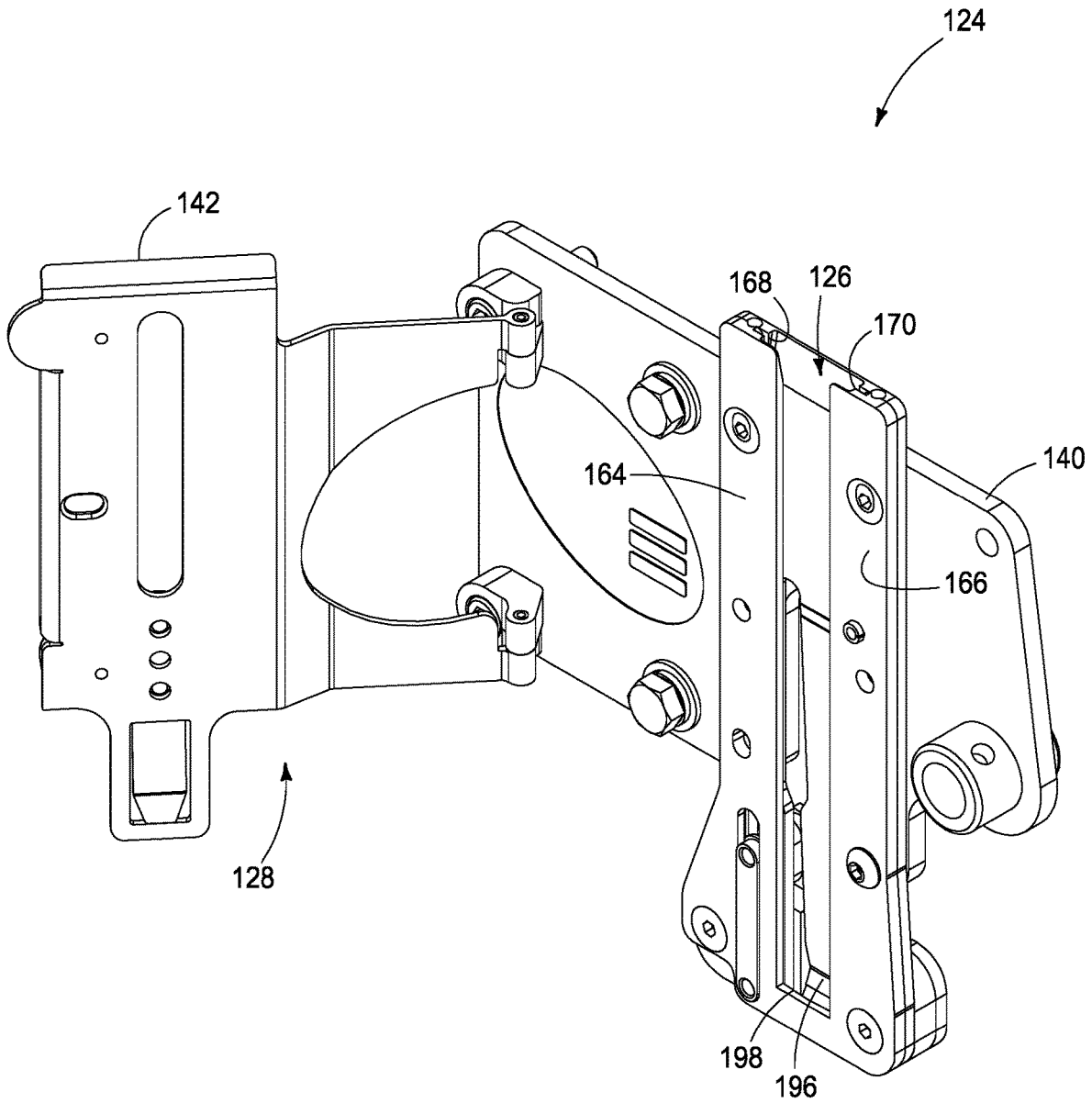
FIG. 12 is a perspective front view from above of the component closure strip guide assembly of FIG. 11.

FIG. 12 is a perspective front view from above of component closure strip guide assembly 124 of FIG. 11. More particularly, door 128 and included plate 142 is shown pivoted to an open cleaning or maintenance position carried by mounting plate 140. Closure cutter edges 196 and 198 are provided at a downstream, or bottom end of expansible guideway 126. Separately formed spacer side strips 164 and 166 are affixed with threaded fasteners to form undercut grooves 168 and 170 of guideway 126 which further help to guide and retain a strip of closures as they are moved downwardly through guideway 126.

Figure 13:
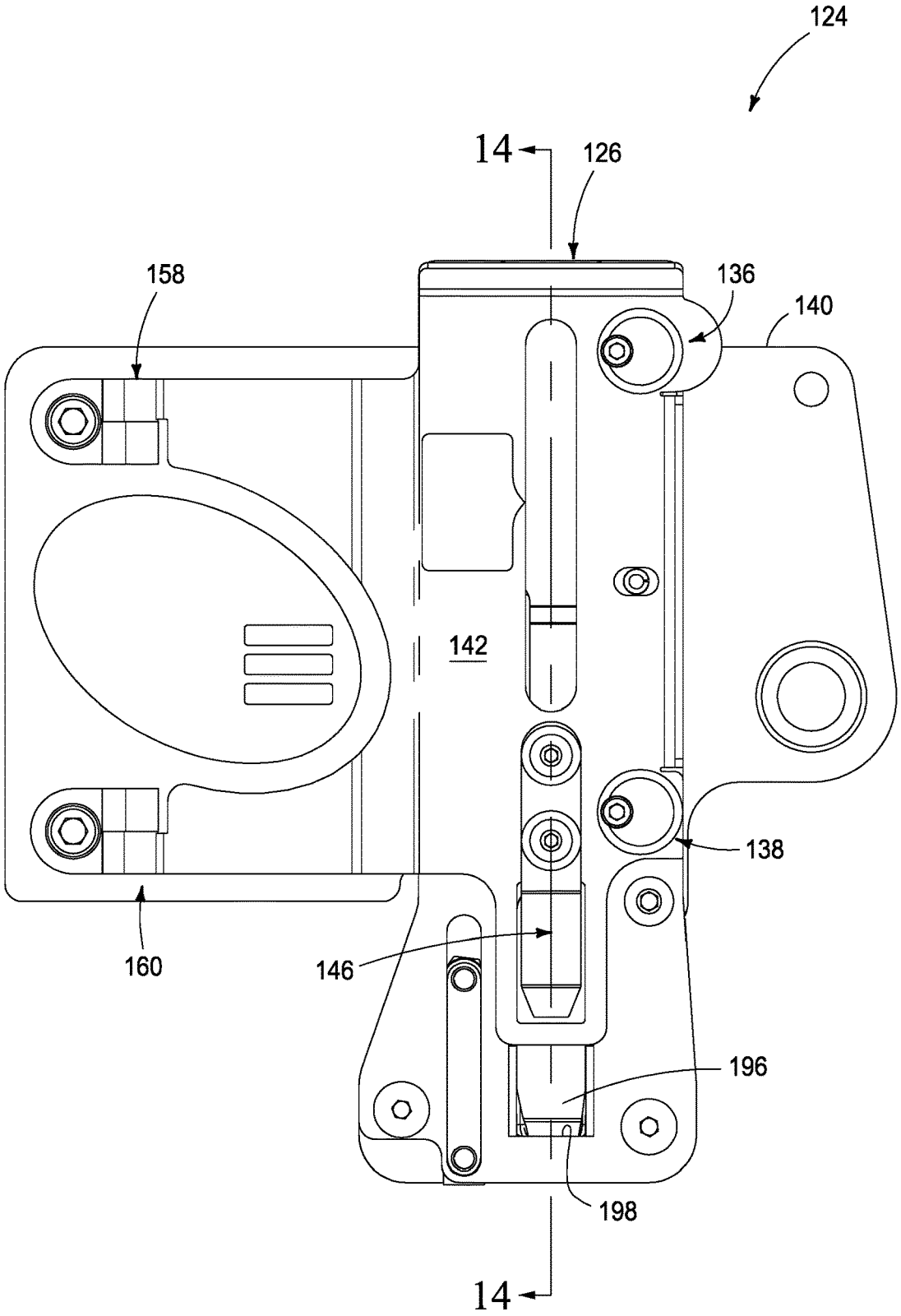
FIG. 13 is a front elevational view of the closure strip guide assembly of FIG. 12.

FIG. 13 is a front elevational view of closure strip guide assembly 124 of FIG. 12. More particularly, hinge assemblies 158 and 160, magnetic latch assemblies 136 and 138, and spring steel clip assembly 146 are shown mounted to front plate 142 at various illustrated locations for pivotal support on mounting plate 140. Closure cutter edges 196 and 198 are shown provided at a downstream end of guideway 126

Figure 14:
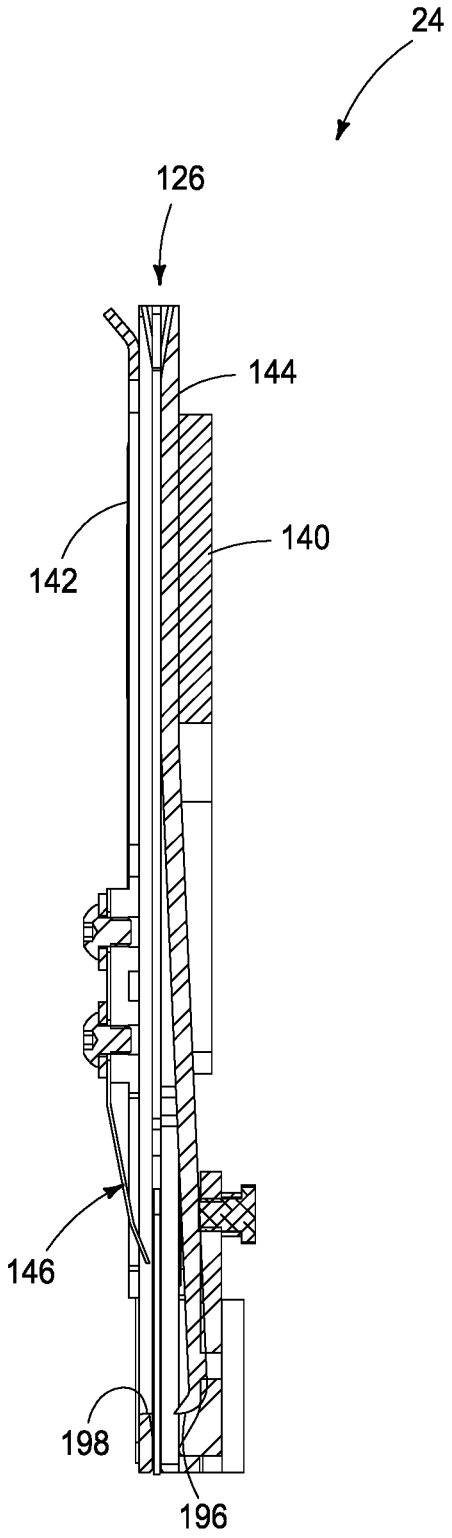
FIG. 14 is a vertical sectional view of the closure strip guide assembly taken along line 14-14 of FIG. 13.

FIG. 14 is a vertical sectional view of closure strip guide assembly 124 taken along line 14-14 of FIG. 13. More particularly, Front plate 142 and back plate 144 are held together to form an expansible guideway 126 for a strip of closures (not shown). Plates 142 and 144 are affixed onto mounting plate 140. Spring steel clip assembly 146 is carried by plate 142 to prevent upward movement of a strip of clips, while cutting edges 196 and 198 cooperate in engagement to sever individual closures, or clips from a strip.

Figure 15:
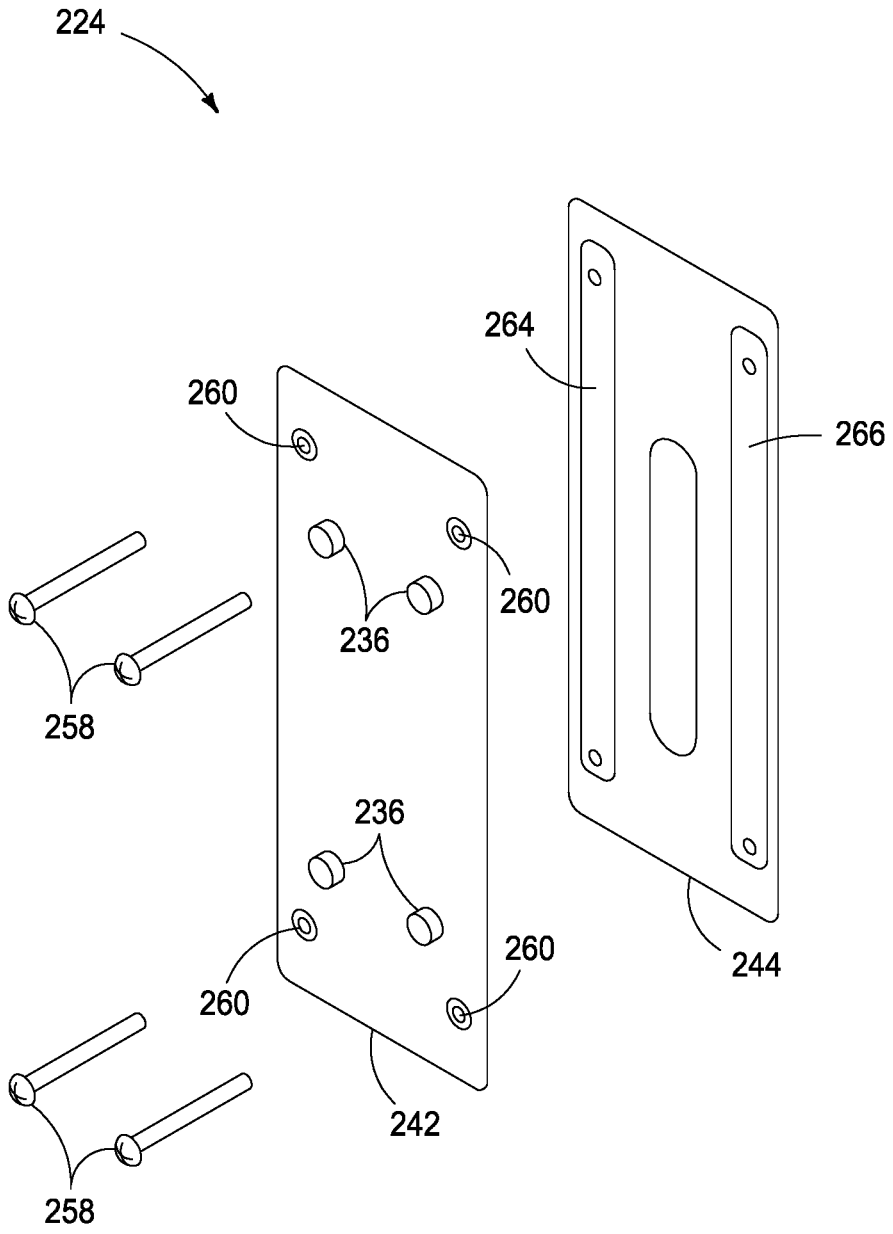
FIG. 15 is a simplified perspective view from above of a second alternate component closure strip guide assembly over that shown in FIG. 1-14 having a magnetic plate keeper, or retainer on a front plate that translates relative to the back plate with a closure strip guide assembly having spacer side strips separate from the back plate.

FIG. 15 is a simplified perspective view from above of a second alternate component closure strip guide assembly 224 over that shown in FIGS. 1-14 having a magnetic plate keeper, or retainer 236 on a front plate 242 that translates relative to a back plate 244 with a closure strip guide assembly having spacer side strips 264 and 266 formed as separate pieces attached onto back plate 244. Retainer 236 comprises a rectangular array of spaced apart magnets similar to the magnets used in the assemblies of FIGS. 1-14. However, plates 242 and 244 are urged together to define a normal single closure depth guideway between plates 242 and 244 and bounded on sides by space side strips 264 and 266. A rectangular array of headed posts, or bolts 258 align with bushing bores 260 in front plate 242 (and affix to plate 244) to allow plate 242 to move toward and away from plate 244 to accommodate motion that realizes an expansible guideway depth between plates 242 and 244 when closures jam, or stack up in multiple layers during a misfeed operation.

Figure 16:
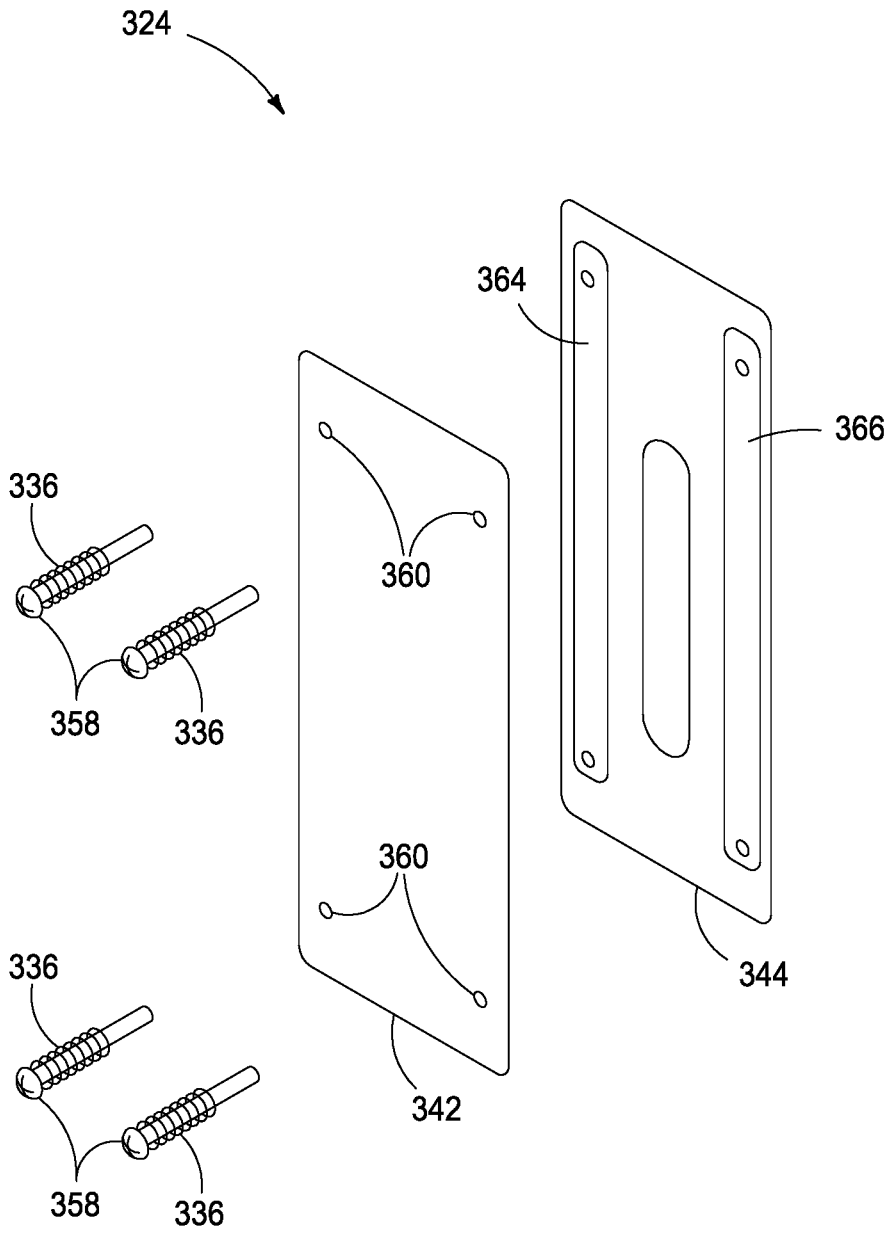
FIG. 16 is a simplified perspective view from above of a third component closure strip guide assembly over that shown in FIGS. 1-15 having a spring-biased plate keeper, or retainer on a front plate that translates relative to the back plate with a closure strip guide assembly having spacer side strips separate from the back plate.

FIG. 16 is a simplified perspective view from above of a third alternative component closure strip guide assembly 324 over that shown in FIGS. 1-15 having a spring-biased plate keeper, or retainer engaging a front plate 342 to translates and bias against a back plate with closure strip guide assembly 324 having spacer side strips 364 and 366 mounted separate from and onto a back plate 344. Guide bushings or bores 360 slidably receive corresponding headed posts, or fasteners 358 (mounted to plate 344) each having a coil spring 336 to cooperate with plate 342 so as to bias plate 342 against plate 344 to provide a single thickness closure gap that expands during a jam and compresses springs 336.

Figure 17:
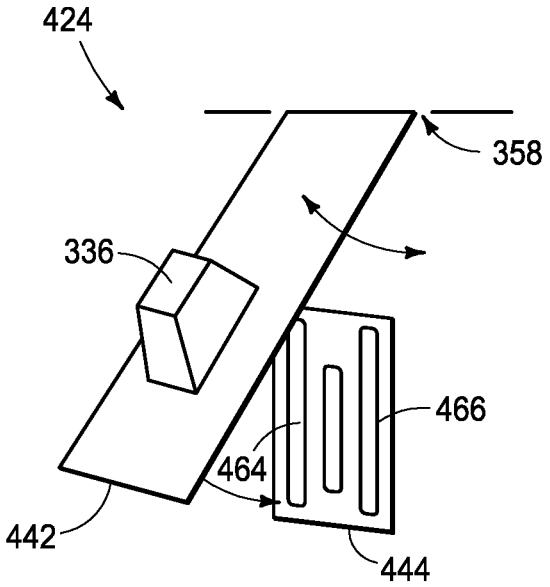
FIG. 17 is a simplified perspective view from above of a third component closure strip guide assembly over that shown in FIGS. 1-16 having a weighted pivoting plate keeper, or retainer on a front plate that translates relative to the back plate with a closure strip guide assembly having spacer side strips separate from the back plate.

FIG. 17 is a simplified perspective view from above of a fourth alternative component closure strip guide assembly 424 over that shown in FIGS. 1-16 having a weighted pivoting plate keeper, or retainer offset weight 336 on a front plate 442 that translates by rotation about pivot axis 358 relative to a back plate 44 with closure strip guide assembly 424 having spacer side strips 464 and 466 separate and attached onto back plate 444.

Figure 18:
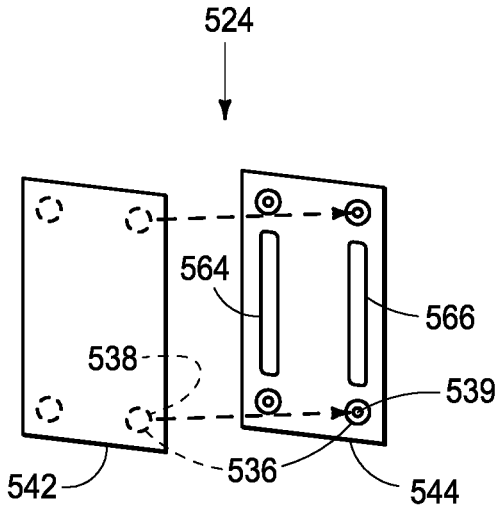
FIG. 18 is a simplified perspective view from above of a third component closure strip guide assembly over that shown in FIGS. 1-17 having a mating snap fastener assembly plate keeper, or retainer on a front plate that translates relative to the back plate with a closure strip guide assembly having spacer side strips separate from the back plate.

FIG. 18 is a simplified perspective view from above of a fifth alternative component closure strip guide assembly 524 over that shown in FIGS. 1-17 having a rectangular array of mating snap fastener assemblies 536 each having a male snap 538 and a complementary female snap 539 that together form a plate keeper, or retainer on a front plate 542 and back plate 544 that unsnap under undue load to let front plate 542 translate relative to back plate 544 with closure strip guide assembly 524 having spacer side strips 564 and 566 separate and affixed onto back plate 544. Accordingly, snap assemblies come undone when there is a jam or overlap of strips passing between plates 542 and 544 along a guideway therebetween, generating an increase in thickness of the guideway during the jam.

Figure 19:
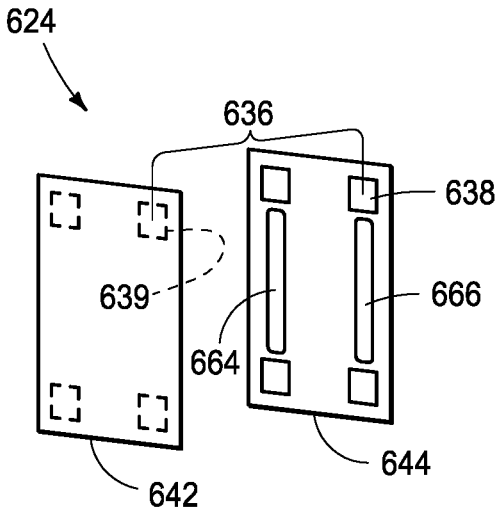
FIG. 19 is a simplified perspective view from above of a third component closure strip guide assembly over that shown in FIGS. 1-18 having a hook-and-loop fastener assembly plate keeper, or retainer on a front plate that translates relative to the back plate with a closure strip guide assembly having spacer side strips separate from the back plate.

FIG. 19 is a simplified perspective view from above of a sixth alternative component closure strip guide assembly 624 over that shown in FIGS. 1-18 having a rectangular array of hook-and-loop fastener assemblies each having a male hook adhesive pad 639 and a female loop adhesive pad 638 on plates 642 and 644, respectively. The resulting plate keeper, or retainer on front plate 642 translates relative to back plate 644 when a jam occurs, increasing thickness of a resulting guideway, with closure strip guide assembly 624 having spacer side strips 664 and 666 separate and affixed onto back plate 644.

Figure 20:
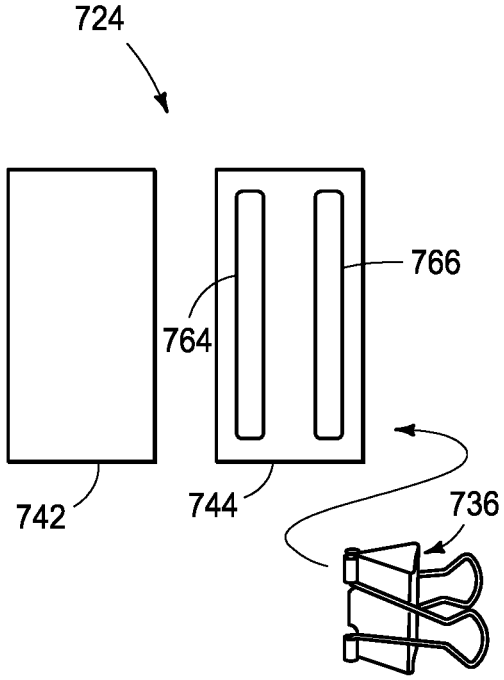
FIG. 20 is a simplified perspective view from above of a third component closure strip guide assembly over that shown in FIGS. 1-19 having a spring clip plate keeper, or retainer on a front plate that translates relative to the back plate with a closure strip guide assembly having spacer side strips separate from the back plate.

FIG. 20 is a simplified perspective view from above of a seventh alternative component closure strip guide assembly 724 over that shown in FIGS. 1-19 having a spring clip plate keeper, or retainer 736 held by one of front plate 742 and back plate 744 that translates and release relative to one of plates 742 and 744 when a closure jam occurs to increase thickness, or slot depth of a resulting guideway, and with closure strip guide assembly 724 having spacer side strips 764 and 766 separate and affixed onto back plate 744.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

I claim:

1. A bag closing apparatus, comprising:

a frame configured to carry a strip of clips; and a closure strip guide having:

a front plate;

a back plate;

at least one strip guide cooperating between the back plate and the front plate to define a strip guide track having a width and a depth to guide a strip of clips; and a displaceable retainer configured to retain together the front plate and the back plate into a stack to have a slot depth sized to slidably receive and guide the strip of clips and enable expansion between the front plate and the back plate under a stack-up jam to accommodate multiple layers of clips in the event the strip of clips dislodges or jams.

2. The bag closing apparatus of claim 1, wherein the strip guide track comprises a pair of spaced apart and substantially parallel strip guides provided between the front plate and the back plate.

3. The bag closing apparatus of claim 2, wherein the pair of strip guides are integrally formed from a unitary piece having a trench forming a track therebetween.

4. The bag closing apparatus of claim 1, wherein the strip guide track is integrally formed from a unitary piece having a trench forming a track.

5. The bag closing apparatus of claim 1, wherein the displaceable retainer comprises a magnet affixed to one of the front plate and the back plate.

6. The bag closing apparatus of claim 1, wherein the displacement retainer further comprising a hinge configured to pivotally affix together the front plate and the back plate operative to enable expansion of a gap thickness.

7. A closure strip guide, comprising:

a front plate;

a back plate carried proximate and spaced from the front plate to provide a gap thickness configured to guide a strip of clips; and a plate keeper configured to retain together the front plate and the back plate to retain the gap thickness to slidably receive and guide the strip of clips and expand the gap thickness between the front plate and the back plate responsive to a stack-up jam to accommodate multiple layers of clips in the event the strip of clips dislodges or jams.

8. The closure strip guide of claim 7, further comprising at least one strip guide cooperating between the back plate and the front plate to define a strip guide track having a width and a depth to guide a strip of clips.

9. The closure strip guide of claim 8, wherein the at least one strip guide comprises a pair of spaced apart and substantially parallel strip guides provided between the front plate and the back plate.

10. The closure strip guide of claim 9, wherein the pair of strip guides are integrally formed from a unitary piece having a trench forming a track therebetween.

11. The closure strip guide of claim 7, wherein the plate keeper comprises a spring configured to urge the front plate and back plate together to provide the gap thickness and compress so as to expand the gap thickness in the event of a jam.

12. The closure strip guide of claim 11, further comprising a plurality of guide posts configured to support the front plate and the back plate for parallel spaced apart reciprocation, the spring provided on at least one of the guide posts to urge together the front plate and the back plate.

13. The closure strip guide of claim 7, wherein the plate keeper comprises a magnet affixed to one of the front plate and the back plate.

14. The closure strip guide of claim 7, further comprising a hinge configured to pivotally affix together the front plate and the back plate operative to enable expansion of the gap thickness.

15. The closure strip feed mechanism of claim 7, further comprising a plurality of guide posts configured to support the front plate and the back plate for parallel spaced apart reciprocation, a magnet provided on at least one of the front plate and the back plate to retain together the front plate and the back plate.

16. The closure strip guide of claim 7, wherein the plate keeper comprises one of a snap, a clip, a hook-and-loop fastener, a retainer configured to hold together the front plate and the back plate with the gap thickness and expand the gap thickness in the event the strip of clips jams.

17. A method of clearing a jam in a strip closure guide of a bag closing apparatus, comprising:

providing a closure strip guide having a front plate, a back plate spaced from the front plate to define a gap sized to guide a strip of clips, and a displaceable retainer configured to retain together the front plate and the back plate sized to slidably receive and guide the strip of clips and enable expansion between the front plate and the back plate;

urging apart the front plate and the back plate responsive to an overlap jam of more than one layer of the strip of clips present in the gap between the front plate and the back plate;

advancing forward the overlap jam between the front plate and the back plate while urged apart; and releasing the more than one layer of the strip of clips from between the front plate and the back plate to clear the overlap jam.

18. The method of claim 17, wherein the displaceable retainer comprises a magnet retaining together the front plate spaced with the gap from the back plate, and further comprising magnetically decoupling and displacing the front plate from the back plate.

19. The method of claim 18, wherein the displacement retainer further comprises at least one hinge, and wherein urging apart comprises pivoting the front plate relative to the back plate.

20. The method of claim 17, wherein urging apart the front plate and the black plate increases thickness of the gap to enable clearance of the jam from between the front plate and the back plate.

* * * * *